United States Patent [19]

Bührer

[11] 4,077,459

[45] Mar. 7, 1978

[54] METHOD AND APPARATUS FOR THE PRODUCTION OF FOUNDRY MOLDS

[76] Inventor: Erwin Bührer, Vogelingasschen 40, 8200 Schaffhausen, Switzerland

[21] Appl. No.: 639,047

[22] Filed: Dec. 9, 1975

[30] Foreign Application Priority Data

Dec. 10, 1974 Switzerland ..... 16405/74

[51] Int. Cl.[2] ..... B22C 15/08

[52] U.S. Cl. ..... 164/40; 164/192; 164/194; 164/207

[58] Field of Search ..... 164/15, 17, 37, 38, 164/39, 158, 161, 162, 164, 169, 192, 193, 194, 40; 425/218

[56] References Cited

U.S. PATENT DOCUMENTS

| | | | |
|---|---|---|---|
| 606,779 | 7/1898 | Flickinger | 164/193 |
| 1,210,318 | 12/1916 | Horton | 425/218 |
| 1,736,365 | 11/1929 | Ramsden | 164/161 |
| 1,794,334 | 2/1931 | Haskins | 164/158 |
| 2,243,092 | 5/1941 | Eteau | 164/193 |
| 2,792,601 | 5/1957 | Buhrer | 164/38 |
| 2,807,845 | 10/1957 | Sawyer | 164/37 |
| 2,842,817 | 7/1958 | Buhrer | 164/38 |
| 3,664,406 | 5/1972 | Mowson et al. | 164/192 X |
| 3,879,156 | 4/1975 | Buhrer et al. | 425/218 |
| 3,879,156 | 4/1975 | Buhrer et al. | 164/192 X |

FOREIGN PATENT DOCUMENTS

| | | | |
|---|---|---|---|
| 231,620 | 6/1963 | Austria | 164/192 |

*Primary Examiner*—Francis S. Husar
*Assistant Examiner*—John McQuade
*Attorney, Agent, or Firm*—Toren, McGeady and Stanger

[57] ABSTRACT

In the production of a foundry mold utilizing mold forming apparatus which includes a pattern device, a molding box arranged on the pattern device and a frame attached to the molding box, a surplus amount of molding sand is initially filled in over the pattern device in excess of the amount required for the production of the mold and during the production operation the excess sand is stripped off by profiled stripping means which are moved relative to the molding box to strip the excess sand along a profile which is dependent upon the configuration of the pattern device. In one aspect of the invention a single profiled stripper may be used and in another aspect a plurality of strippers having differring profiles may be employed. In other aspects of the invention different mechanisms are applied to move the stripping means relative to the molding sand by movement of the pattern device either along a linear path or through a circular path. The stripping means may be formed as stripper plates having an arcuate configuration or they may comprise flat planar profiled strippers. In a further aspect of the invention, the pattern device together with the molding box is rotatably movable from a filling position to a compression position while the stripping means are simultaneously rotated in the same angular direction as the molding box but in such a manner as to effect opposed linear movement between the molding box and the stripping means thereby to effect performance of the stripping operation. The method of the invention requires only a single compression operation which may involve either compression of the molding sand or simultaneous compression and jarring.

23 Claims, 28 Drawing Figures

Fig. 17
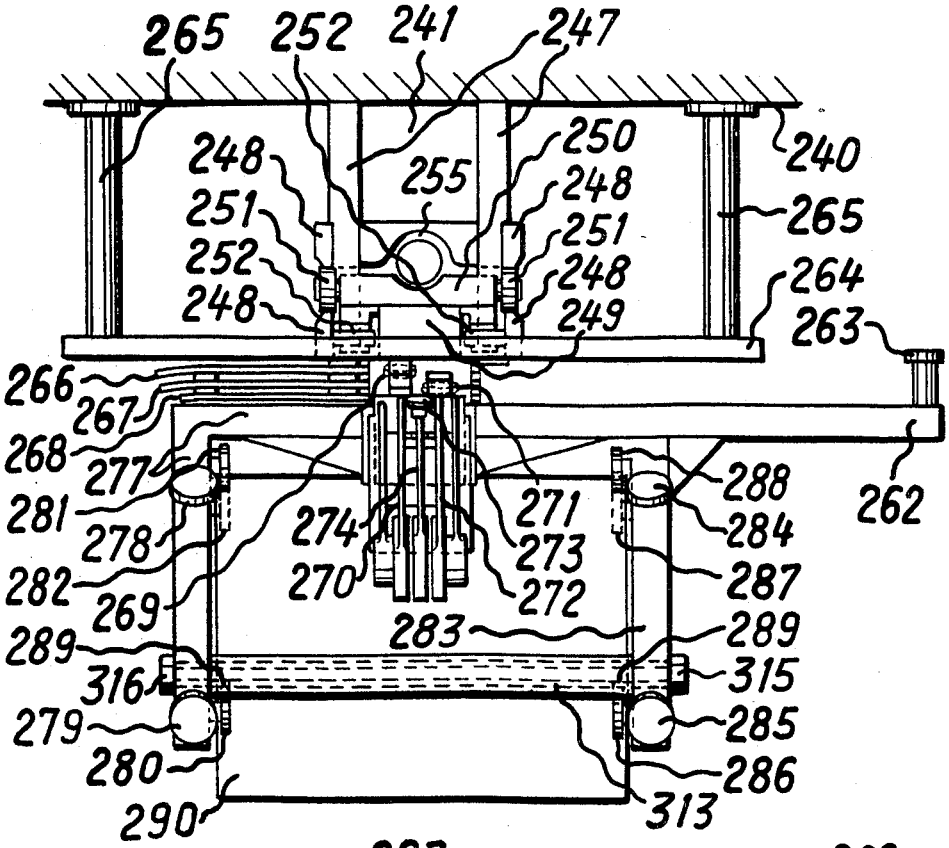
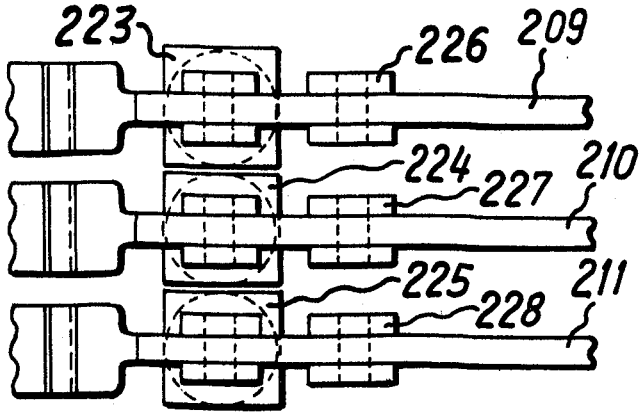
Fig. 21

247
XVI
252
250
251
257
239
253
295
256
254
255
266
249
251
251
267(268)
250
252
246
248
247
261
245
244
243
242
241
XVI 20
312
302
300
298
264
243(30)
290-292
256
296
24
259b
22
304
259a
263
28
301
303

20
260
259b
264
296
243(30)
256
22
28
290-292
24
259a
263

20
259b
243(30)
28
263
256
260
264
22
24
290-292
259a 28
24
263
259b
20
297
256
243(30)
264
22
290-292
259a 20
28
263
24
256
297
243(30)
259a
264
22
299
259b
260
290-292

METHOD AND APPARATUS FOR THE PRODUCTION OF FOUNDRY MOLDS

BACKGROUND OF THE INVENTION

The present invention relates generally to the production of foundry molds by utilization of molding machines which include a pattern device, a molding box arranged thereon and a frame attached on the molding box. More specifically, the invention relates to devices wherein an excess of molding sand above that required for the production of a mold is initially introduced above the pattern device, and only a single compression is effected.

A method for filling granular materials into molding boxes is known from Swiss Pat. No. 301,031, wherein after filling the filled-in material is precompressed by inertia forces acting perpendicular to the pattern plane. Subsequently, the material is compressed again using a hopper containing a granular material and provided with a bottom closure whose outflow cross section corresponds substantially to the inside cross section of the molding box. This hopper is attached on the molding box during the filling of the latter, and the precompression is effected with the hopper attached. In this method, more granular material is fed to the hopper than is required for the production of the mold, and the excess sand is separated between the precompression and the secondary compression by slicing plates forming the closure of the hopper.

The attachable hopper has on its underside a reinforced edge so that a sand bed surmounting the box edge is formed before the secondary compression (see "Giesseri", 1957, p. 564,578, FIG. 7*e*, paper by Obering, Walter Goetz).

Furthermore a method for the mechanical production of molds from granular material is known from Swiss Pat. No. 308,043 where the granular material is precompressed by jarring with the frame attached, and after the precompression the excess sand is separated and the frame lifted, after which the mold is subjected to secondary compression with the frame lifted.

A molding machine with a sand stripper is also known from Swiss Pat. No. 537,222 wherein the excess sand level is stripped off between the precompression and the secondary compression above a certain amount parallel to the upper edge of the molding box.

As has been shown in the paper by Goetz referred to above, particularly FIG. 8 thereof, which also applies to the embodiments according to Swiss Pat. Nos. 308,043 and 537,222, a decisive improvement of the compression can be achieved under these conditions for the pattern device represented in FIG. 5. In order to achieve this uniformity of compression, an effective or intensive precompression of the filled granular material with the attached hopper is necessary before the excess molding sand is removed, and subsequently the secondary compression must be effected with the hopper lifted.

The present invention is aimed toward enabling production of molds of more uniform compression than is presently possible from clay-bonded granular material, if pattern devices having high patterns or considerable depressions must be utilized.

Another object is to considerably increase the number of molds that can be produced hourly for each pattern device without reducing their quality regarding uniform compression.

A further object is to omit the precompression of the molds by jarring with a sand bucket or sand frame attached, in order to avoid the secondary movements of the molding box and of other parts resting on the latter relative to the pattern device, which are caused by elastic deformation. These secondary movements can cause cracking of mold edges during the precompression by jarring, and they are also the cause of the annoying noise as well as of the excess wear on pattern devices, molding boxes, etc.

Another object is to substantially simplify existing methods in order to considerably reduce the investment costs for such plants and to reduce the maintenance costs in operation.

SUMMARY OF THE INVENTION

Briefly, the present invention may be described as apparatus for the production of a foundry mold including a pattern device, a molding box arranged thereon, and a frame attached on the molding box. In the utilization of the apparatus, more molding sand than initially required for the production of a mold is filled in over the pattern device.

After the molding sand has been filled in, the excess sand is stripped off with a profiled stripper with the frame attached on the molding box, and subsequently compressed with the frame attached by pressing or simultaneous pressing and jarring.

According to the invention, the excess molding sand can furthermore be stripped off with a profiled stripper shaped in accordance with the design of the pattern.

The method according to the invention can be so carried out that the excess molding sand is stripped off with a stripper having a varying profile.

The method according to the invention can also be so carried out that the movement of the pattern device and of the parts connected thereto takes place in a linear path from the position of the molding sand filling device to the compression position, the molding sand stripper(s) being moved vertically relative to the molding box.

However, the method according to the invention can also be so carried out that the movement of the pattern device and of the parts connected thereto is effected in a circular path from the position of the molding sand filling device into the compression position, the molding sand stripper(s) being moved at the same angular speed as the rotation of the pattern device, with the molding sand stripper(s) being guided transversely to the direction of motion and centrally to the pattern device.

An important feature of the apparatus of the invention involves the fact that at least one profiled stripper is provided which is adjustable in height by control means operating according to a given program with the feeding device being so designed that the distance covered during a relative movement between the molding box and the molding sand stripper corresponds at least to the horizontal extension of the molding box.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive materials in which there are illustrated and described preferred embodiments of the invention.

DESCRIPTION OF THE DRAWINGS

In the Drawings

FIG. 17 is a view of FIG. 16 taken in the direction of arrow D;

FIG. 21 is a partial view taken in the direction of arrow E in FIG. 19;

DETAILED DESCRIPTION OF THE PREFERRED EMBODIMENTS

Figure 1:
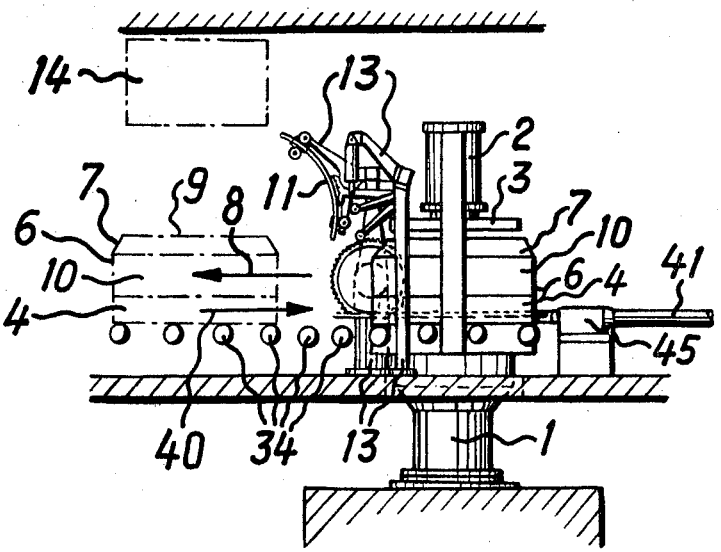
FIG. 1 is a schematic plan view of a molding machine with a stripping device taken in the direction of arrow A in FIG. 2.
Figure 2:
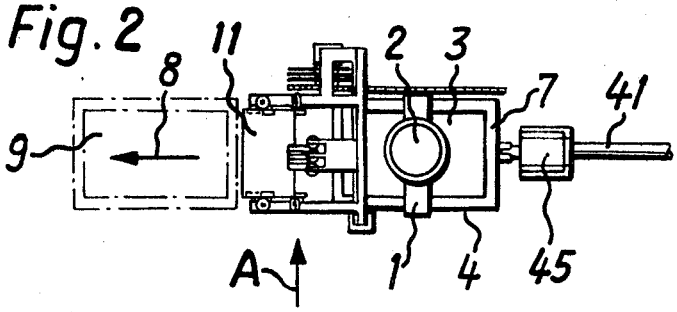
FIG. 2 is a top view of the machine of FIG. 1.

FIGS. 1 and 2 denote a press 1 with a press cylinder 2 and a press plate 3, in which there is arranged a pattern device 4 on which there is secured a molding box 6 with an attached frame 7 which are filled with molding sand. After the compression of the mold 10 by pressing or simultaneous pressing and jarring, the pattern device with the attached parts 10 and 7 is pulled back in a straight line in the direction of arrow 8 into position 9 with the press plate 3 lifted.

In position 9, the mold 10 with frame 7 resting on the pattern device 4 is lifted in known manner and moved away, while another molding box 6 with another frame 7 is attached on the pattern device 4. During the movement of the pattern device 4 from the position in press 1 in the direction of the arrow 8 into position 9, strippers 11, which are held in a device 13, are in a raised position. A feeding device 14 for the molding sand, which may be structured, for example, according to Swiss patent 462,392, is arranged above position 9, and is adapted to pour the molding sand required for the production of the mold. With the pattern device 4 in position 9, a predetermined excess of molding sand will be poured over the entire mold surface of the pattern device 4.

While the pattern device 4 with the attached parts 6 and 7, as well as with the filled-in molding sand, is moved in a straight line in the direction of arrow 40 from position 9 into the position of the press 1, the excess molding sand can be stripped off in a manner to be described hereinafter with the stripper 11 moving vertically relative to the molding box 6. The feeding of the pattern device 4, with the parts 6 or 10 and 7 connected with it, can be effected over a hydraulic feeding device consisting of a hydraulic cylinder 41 and rollers 34.

Figure 3:
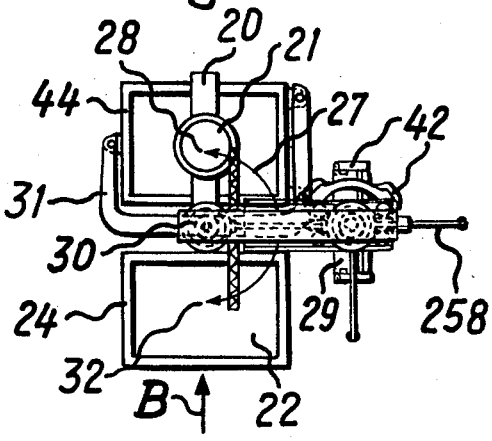
FIG. 3 is a schematic plan view of another molding machine with a stripping device.
Figure 4:
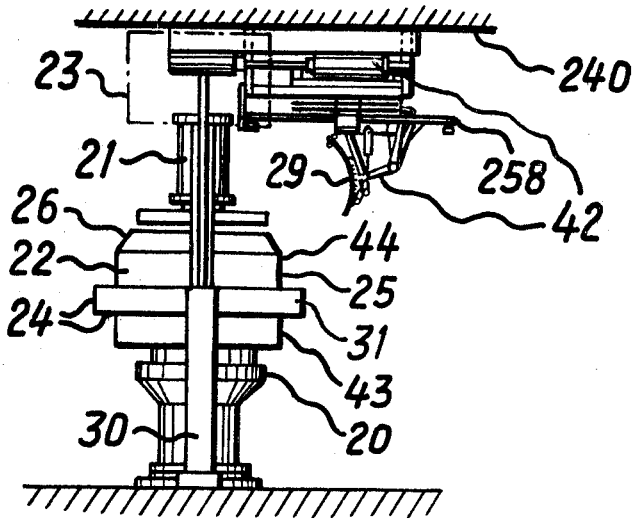
FIG. 4 is a view of the machine of FIG. 3 taken in the direction of arrow B.

FIGS. 3 and 4 show another embodiment of a molding machine according to the invention which includes a press 20 having a press cylinder 21. Above a position 22 there is arranged a feeding device 23 for the molding sand, which can fill-in the molding sand required for the production of the molds with a predetermined excess of molding sand uniformly over the entire mold surface of the pattern device 24. On the pattern device 24 there is attached a molding box 25 and a frame 26. During the movement of the pattern device 24 with the attached molding box 25, the frame 26, and the filled-in molding sand on the circular path 27 in the direction of the arrow 28, from position 22 into the position in the press 20, the excess molding sand can be stripped off in a manner to be described hereinafter with strippers 29, which can be moved vertically relative to the molding box 25 and which are held in the device 42. For the case shown in FIGS. 3 and 4, the press 20 can be designed advantageously. Turning of the pattern device 24 by means of the rotary column 30 and arm 31 is made possible by the fact that one column, which connects the press cylinder 21 with the mold table 43, can be separated completely over a clutch and be frictionally connected after the pattern device 24 is swung in, so that it forms a gantry with the press cylinder 21 and the mold table 43. After the mold 44 is compressed, it can be turned again with the pattern device 24 and the frame 26 by means of a rotary column 30 and the arm 31 from the position in the press 20 in the direction of the arrow 32 into position 22, after one column of the press cylinder 21 has been separated from the mold table 43. In position 22, the pattern device 24 can be placed on a support and subsequently the mold with the frame 26 can be lifted and another molding box 25 with another frame 26 can be attached.

Figure 23:
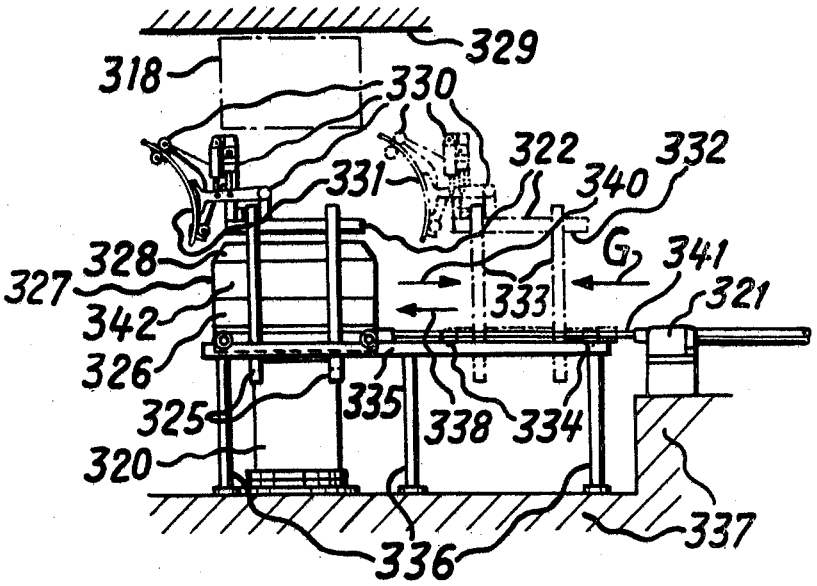
FIG. 23 is a schematic view of another molding machine with a stripping device taken in the direction of arrow F in FIG. 24.
Figure 24:
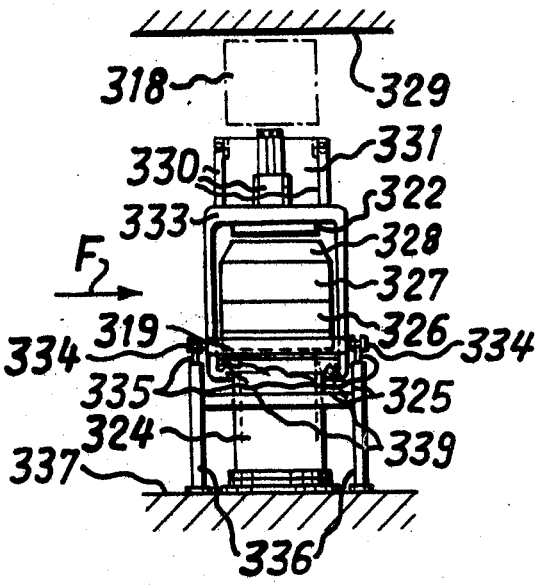
FIG. 24 is a view of FIG. 23 taken in the direction of arrow G in FIG. 23 without the feeding device.

FIGS. 23 and 24 show a molding machine of another embodiment of the invention. The press 320 consists of a cylinder 324 which has several stops 325. In cylinder 324 there is guided a piston (not shown), which is rigidly connected with a mold table 319 which carries a pattern device 326, a molding box 327 and a frame 328. Above the parts 319 and 326-328 there is arranged on a supporting construction 329 a sand filling device 318, with which the molding sand required for the production of the molds is filled-in over the pattern device 326 with a predetermined excess of molding sand. During the filling of the molding sand, the press plate 322, on which the device 330 is secured with which the strippers 331 are held, is in position 332. The press plate 322 bears over yokes 333, with which it is rigidly connected, over rollers 334 on the guide rails 335, which in turn bear over a supporting construction 336 on the bottom 337. A feeding device 321, which bears on the bottom 337 and is designed, for example, as a hydraulic cylinder, can move with its piston rod 341, which is connected with the yokes 333, the press plate 322, and the parts connected with it from the extended position 332 in the direction of the arrow 338 into the position in press 320, and strip off the excess molding sand according to the invention. The device 330 in FIGS. 23 and 24, which bears on the press plate 322, differs from that according to FIG. 19 only in that in FIG. 19 the device bears over columns 212 on the bottom. Since both the design of the strippers 331 and the guides of the latter, and their path/time dependent control is identical with that of the strippers 197-199, reference is made to the description of FIG. 19. It should be noted that in the design according to FIG. 19 the displacement path of the pattern device 235, takes over the function of the displacement path of press plate 322 in FIG. 23.

When press plate 322 is in position in the press 320, the press 320 is started. The mold table 319 with the pattern device 326, molding box 327, frame 328 and the uncompressed molding sand filling, stripped off with a profile, is lifted and pressed against the press plate 322. Since the yokes 333 engage with their hook-shaped parts 339 the stops 335 from below and make contact, the press plate 322 exercises a back-pressure and then compresses the molding sand filling according to the invention with frame 328 attached.

After the compression, the press 320 is stopped. The mold table 319 with the attached parts drop in the position shown in FIGS. 23 and 24, after which, by actuating the feeding device 321, the press plate 322 and the parts connected with it can be moved in the direction of the arrow 340 into the extended position 332. When press plate 322 and the parts connected with it are in position 332, the mold 342 with frame 328 can be lifted, and another molding box 327 with another frame 328 can be attached on the pattern device 326.

FIGS. 5–12 show pattern devices on which molding boxes and frames are attached, which contain molding sand that has been filled in to excess and subsequently stripped off with a profiled stripper. The molding sand is not precompressed.

Figure 5:
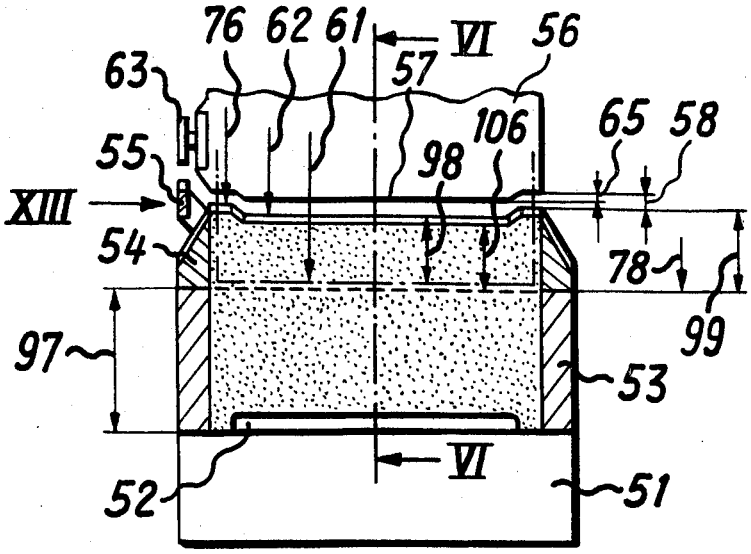
FIG. 5 is a section taken along the line V—V of FIG. 6, not extending through the pattern device.
Figure 6:
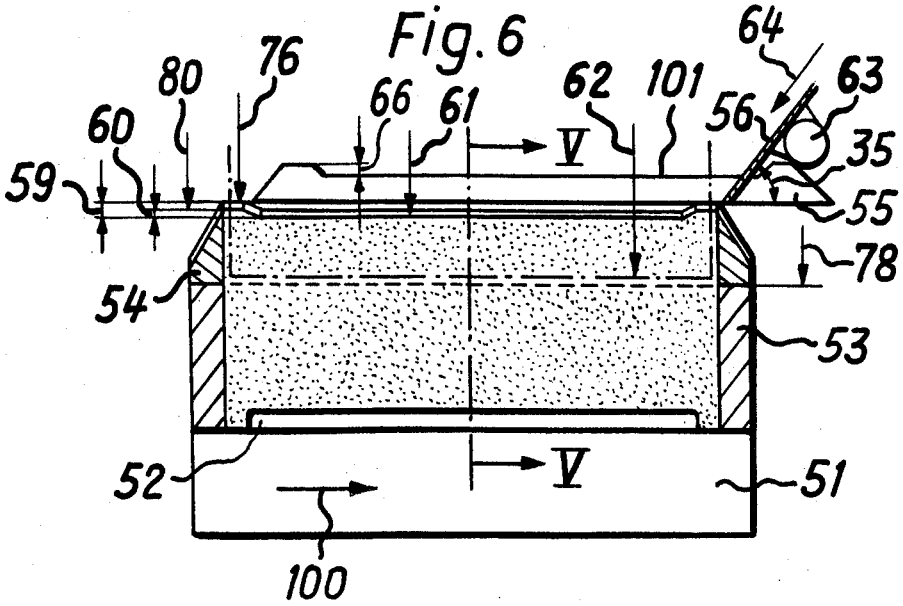
FIG. 6 is a section along the line VI—VI in FIG. 5, not extending through the pattern device.

FIGS. 5 and 6 show a pattern device 51 which has low patterns 52 and on which a molding box 53 is attached which carries a frame 54 with which a cam 55 is rigidly connected. The stripper 56, which is arranged in an acute angle 35 transverse to the direction of motion 100 and has a stripping profile 57, is represented in FIG. 5 as raised by a distance 58, so that the stripping profile 57 of the stripper 56 can be clearly seen. The stripping operation and the devices required for this operation will be described below.

The profile of the molding sand filling according to FIGS. 5 and 6 creates in the inner corners of the molding box an elevation 59, and along the inner walls of the molding box an elevation 60 of the molding sand profile relative to the height of the molding sand. The broken line 62 shows the height of the finish-compressed mold. The difference between the uncompressed sand filling according to the molding sand height 61, 76 and 80 and the upper edge 78 of the molding box depends, apart from the height 97 of the molding box, on the portion of binding clay and on the moisture of the molding sand, as well as on the pour height of the molding sand. The height difference 98,99 and 106 between the molding sand height 61, 76 and 80, respectively and the upper edge 78 of the molding box is normally about 130 mm, 170 mm and 150 mm respectively, for a molding box 53 with a height of 300 mm. The elevation 60 is about 20 mm, and the elevation 59 about 40 mm, compared to the molding sand height 61, and thus takes into account the lower volumetric weight of the sand filling before the compression along the inner walls of the molding box and in the inner corners of the molding box. Based on the foregoing assumptions, the finish-compressed mold surmounts the upper edge 78 of the molding box slightly, corresponding to the broken line 62. According to the invention only one stripper 56 is required for low patterns, if they are to be molded in high molding boxes whose profile is offset in the center of the distance 65. The stripper 56 can be moved by pressing means (not shown), for example, a compressed air cylinder, in the direction of the arrow 64. If the pattern device 51 is moved with the parts 52–54 in the direction of the arrow 100, the roller 63, which is rigidly connected with the stripper 56, rolls along the profile 101 of the cam 55 and controls the vertical position of the stripper 56. The distance 65 on the stripper 56 corresponds to the distance 66 of cam 55, so that the elevation 59 corresponds to double the amount of the elevation 60.

The embodiments according to FIGS. 5 and 6 show that, if the height of the pattern 52, compared to the mold box height 97, is very low, the profiling of the surface of the filled-in molding sand before the compression can be effected with only one stripper. If the profiling of the surface of the filled-in molding sand, which is neither precompressed nor compressed, is effected according to FIGS. 5 and 6, so that above each mold surface the amount of molding sand which a mold of uniform compression is to have is already filled-in, there is obtained, after the compression is effected with the attached frame 54 according to the broken line 62, a uniformly compressed mold. The profiling of the surface of the filled-in molding sand according to FIGS. 5 and 6 is therefore stripped off with a constant profile transverse to the direction of motion 100.

Figure 7:
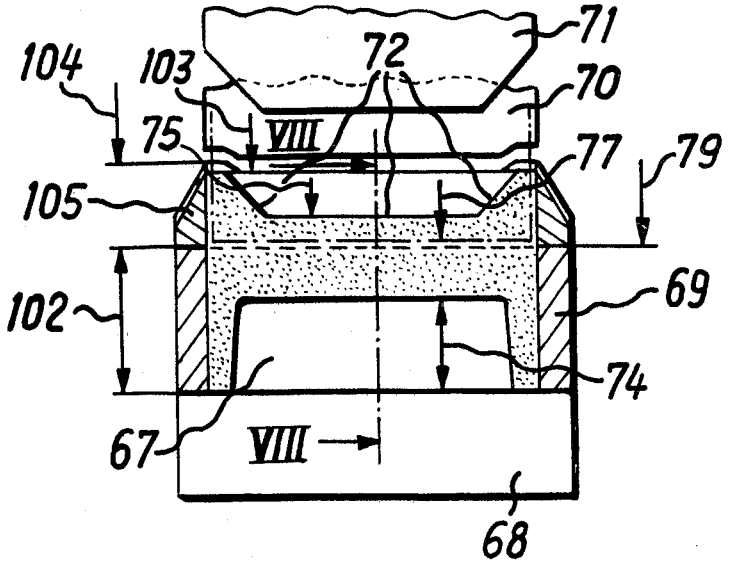
FIG. 7 is a section taken along line VII—VII of FIG. 8, not extending through the pattern device.
Figure 8:
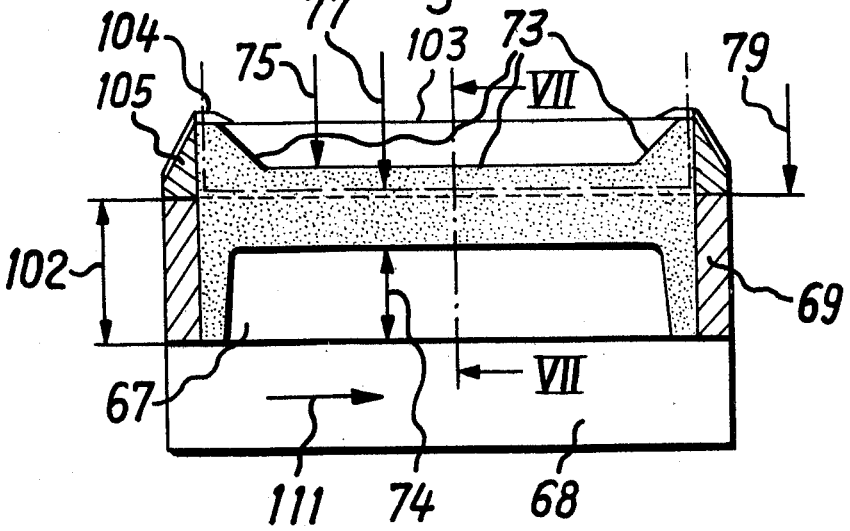
FIG. 8 is a section taken along the line VIII—VIII in FIG. 7 not extending through the pattern device.

FIGS. 7 and 8 show the application of the invention for a situation where the height 74 of the pattern 67 of the pattern device 68 is very great, compared to the height 102 of the molding box 69. In order to obtain a uniformly compressed mold, two different strippers 70 and 71 are required for profiling the molding sand surface before the compression during the movement of the pattern device 68 with the parts 69 and 105 attached thereon, in the direction of motion 111. The stripper 70 in FIG. 7 is profiled identically with the stripper 56 in FIG. 5 and performs the same function as the stripper 56 in FIGS. 5 and 6. The stripper 70 thus profiles the stripped off sand surface as shown in FIGS. 5 and 6. The second stripper 71, which is preferably arranged ahead of the stripper 70, and bears on the latter, changes the sand surface produced by the stripper 70 corresponding to line 72 in FIG. 7 and 73 in FIG. 8. The control of the strippers 70 and 71, which is independent of each other, will be described hereinafter in connection with FIGS. 13 and 14 and FIGS. 16, 18 and 19, respectively.

The broken line 77 shows the height of the finish-compressed mold. If the height 74 of the pattern 67 is 200 mm, for example, and the height 102 of the molding box 69 is 300 mm, the stripper 71 must be so profiled and controlled that the distance of the uncompressed profiled sand filling between the molding sand height 75 and the upper edge 79 of the molding box is about 60 mm. The molding sand heights 103 and 104, which are produced by the stripper 70, correspond to the molding sand heights 80 and 76 in FIGS. 5 and 6, if ordinary molding sand is used in this case. The profiling of the surface of the filled-in sand which is neither precompressed nor compressed, along the lines 72 and 73, as well as in the edge zones according to the heights 103 and 104 is so selected that above each mold surface the amount of molding sand is already filled in which is necessary for a mold of uniform compression. For this reason there is obtained, after the compression with the attached frame 105, a uniformly compressed mold according to the broken line 77.

Figure 9:
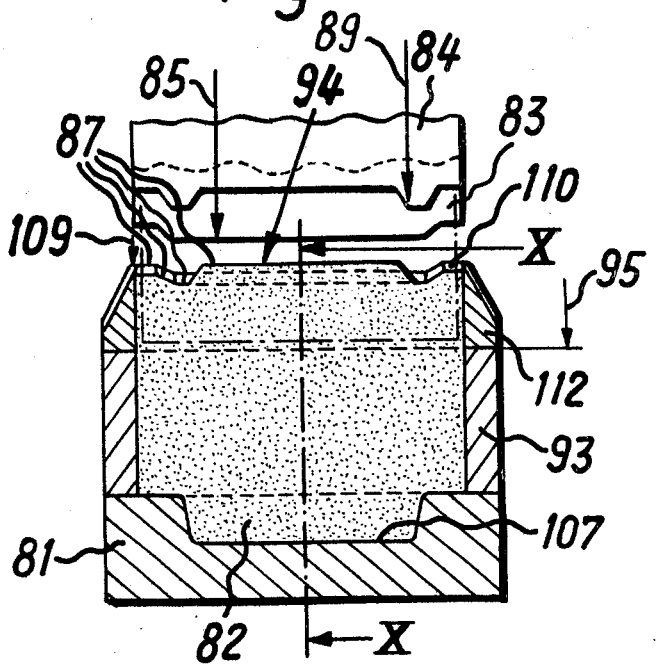
FIG. 9 is a section taken along the line IX—IX in FIG. 10.
Figure 10:
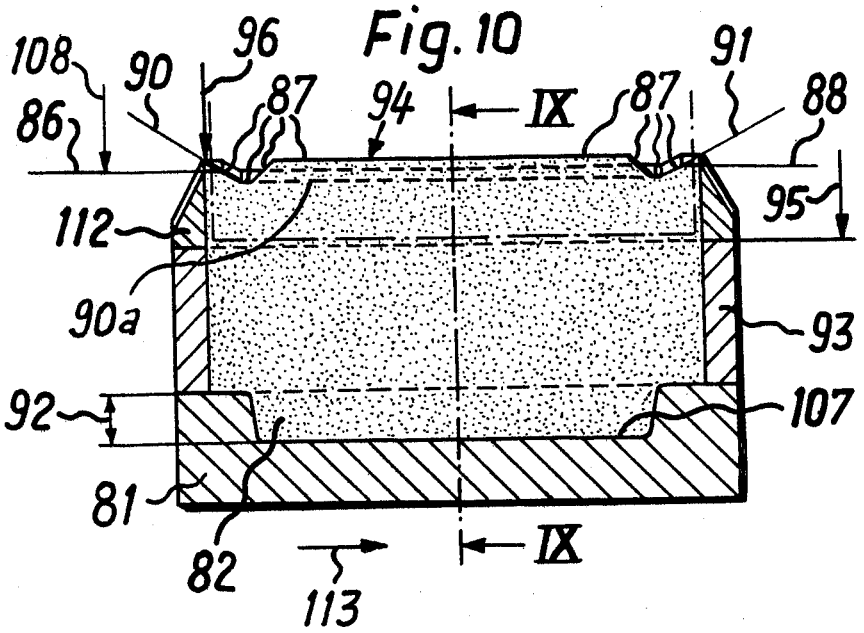
FIG. 10 is a section taken along the line X—X in FIG. 9.

FIGS. 9 and 10 show the application of the invention in a case where the pattern device 81 has no projecting patterns, but a depression 107 for molding a sand ball 82. In order to obtain a uniformly compressed mold, two strippers 83 and 84 are required in this case for profiling the molding sand surface before the compression during the movement of the pattern device 81, with the parts 93 and 112 attached thereon, in the direction of the arrow 113. Stripper 83 has the same profile as strippers 56 and 70 shown in FIGS. 5 and 7, respectively. Stripper 83 is so guided, in a manner to be shown below, that the part 85 of the profile is controlled according to the profile 86, 87 and 88 (see FIG. 10). The profile of stripper 84 corresponds to the sand profile 87. Stripper 84 is so guided, in a manner to be shown below, that the part 89 of its profile is controlled according to the profile 90, 90*a* and 91 in FIG. 10. If the depth 92 of the mold ball 82 is 100 mm, for example, and the height of molding box 93 is 300 mm, strippers 83 and 84 must be so controlled that the difference between the compressed sand filling according to the molding sand height 94 and the upper edge 95 of the molding box is about 170 mm. The molding sand height 96 and 108 is produced by stripper 83 and the molding sand height 110 by stripper 84. The molding sand height 109 and 96 in FIGS. 9 and 10 correspond to the molding sand height 104 in FIGS. 7 and 8 and the height 76 in FIGS. 5 and 6. The molding sand heights 108 and 110 in FIGS. 9 and 10 correspond to the molding sand height 103 in FIGS. 7, 8 and height 80 in FIG. 6.

Figure 11:
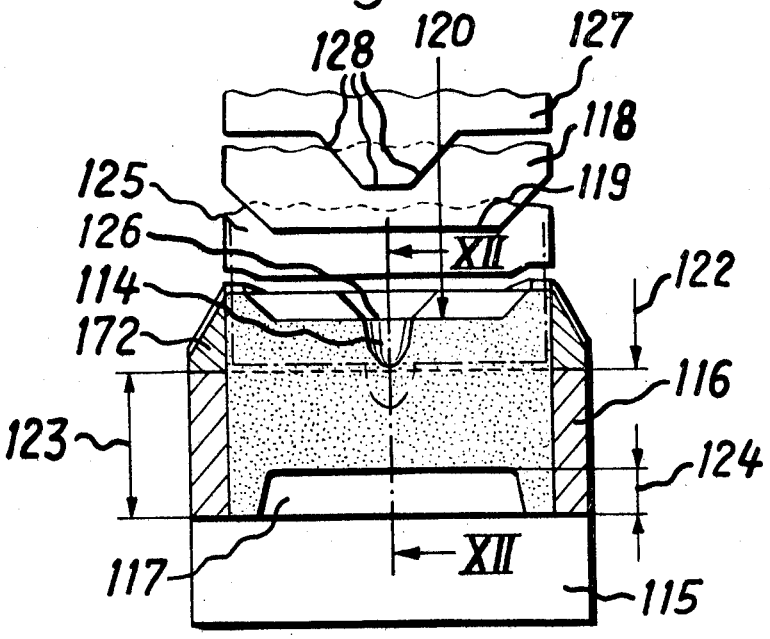
FIG. 11 is a section taken along the line XI—XI in FIG. 12.
Figure 12:
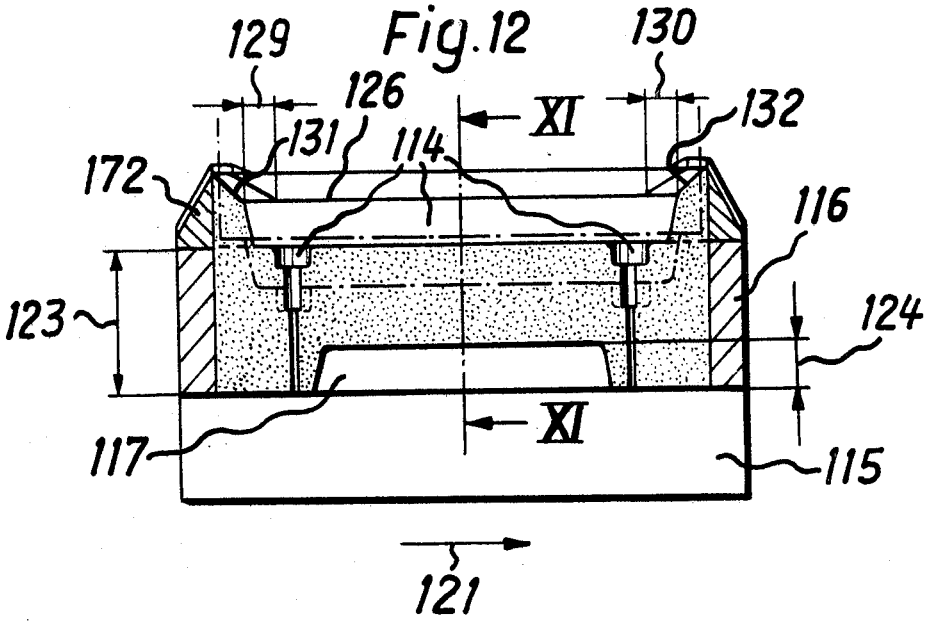
FIG. 12 is a section taken along the line XII—XII in FIG. 11.

FIGS. 11 and 12 show by way of example the application of the invention with the use of an upper trough pattern 114 which is attached on the pattern device 115. Stripper 125, whose profile corresponds to the strippers 56, 70 and 83, assumes in this case the profiling operation of the molding sand heights along the inner walls of the molding box and in the inner corners of the molding box in the manner already described in connection with FIGS. 5–10. Stripper 118 assumes the function of stripper 71 of FIG. 7. If the height 123 of mold box 116 is 300 mm, for example, and the height 124 of pattern 117 is 100 mm, the part 119 of the profile of stripper 118 must strip off the molding sand to a height 120, in a manner similar to that already described for FIGS. 7 and 8, during the movement of the pattern device 115 in the direction of arrow 121 in such a way that the molding sand height 120 surmounts the upper edge 122 of the molding box by about 100 mm. The molding sand height 120 surmounts the top side 126 of the upper trough pattern 114 slightly. The function of the third stripper 127 is to strip off with the part 128 of its profile the remaining sand whih stripper 118 cannot strip off over the partial distance 129 and 130, along the profile lines 131 and 132.

Thus, from the foregoing, it will be seen that FIGS. 7 – 12 show examples of devices wherein stripping occurs in the directions of motion 111, 113, 121 with a profile varying transversely to the directions of motion 111, 113, 121.

FIGS. 5 – 12 show that a stripper 56, 70, 83 and 125 wit a profile which is independent of the shape of the pattern device is required in each case, of which the profile depends only upon the height of the molding box 53, 69, 93, 113, the pour height during the filling of the molding sand, the content of binding clay in the molding sand and its moisture also being taken into consideration. For pattern 52, whose height is very low compared to the height 97 of molding box 53, only the above mentioned stripper 56, 70, 83, 125 is required. This case is represented in FIGS. 5 and 6, where stripper 56 consists only of a flat plate which is controlled in height by a roller 63.

If the pattern device 68, 81 or 115 has patterns 67, 117, whose height 74, 124 is considerable relative to the height 102, 123 of the molding boxes 69, 116, or has a depression 107 which is considerable relative to the height of molding box 93, a second stripper is required whose profile and height control must be adapted to the respective pattern device. This second stripper 71, 84, 118 is preferably so arranged in the direction of motion 111, 113, 121 that it is ahead of the stripper 70, 83, 125 and bears on the latter.

If upper mold parts are produced, for example, which have upper trough patterns 114 or other pattern parts to be attached on the pattern device 115, which contract during the compression of the mold, an additional stripper 127 is required, which strips off additionally the molding sand over the partial distances 129 and 130 on the top side 126 during the movement of the pattern device 115 in the direction of motion 121. Stripper 127 is preferably arranged as the front stripper in the direction of motion 121 and bears on the following strippers 118 and 125. If several upper course patterns 114 are arranged transversely to the direction of motion 121, the profile of stripper 127 must be designed accordingly.

In case several upper trough patterns 114 are arranged in the direction of motion 121, the control movement of stripper 127, which must be adapted to the length of the upper course patterns, must be selected accordingly. Summarizing it can be said that the strippers 71, 84, 118 and 127 strip off the excess molding sand with a profile corresponding to the design of the pattern.

The present invention requires for its realization more than three strippers if the profiling of the sand surface has more than three different profiles transverse to the stripping direction.

Figure 13:
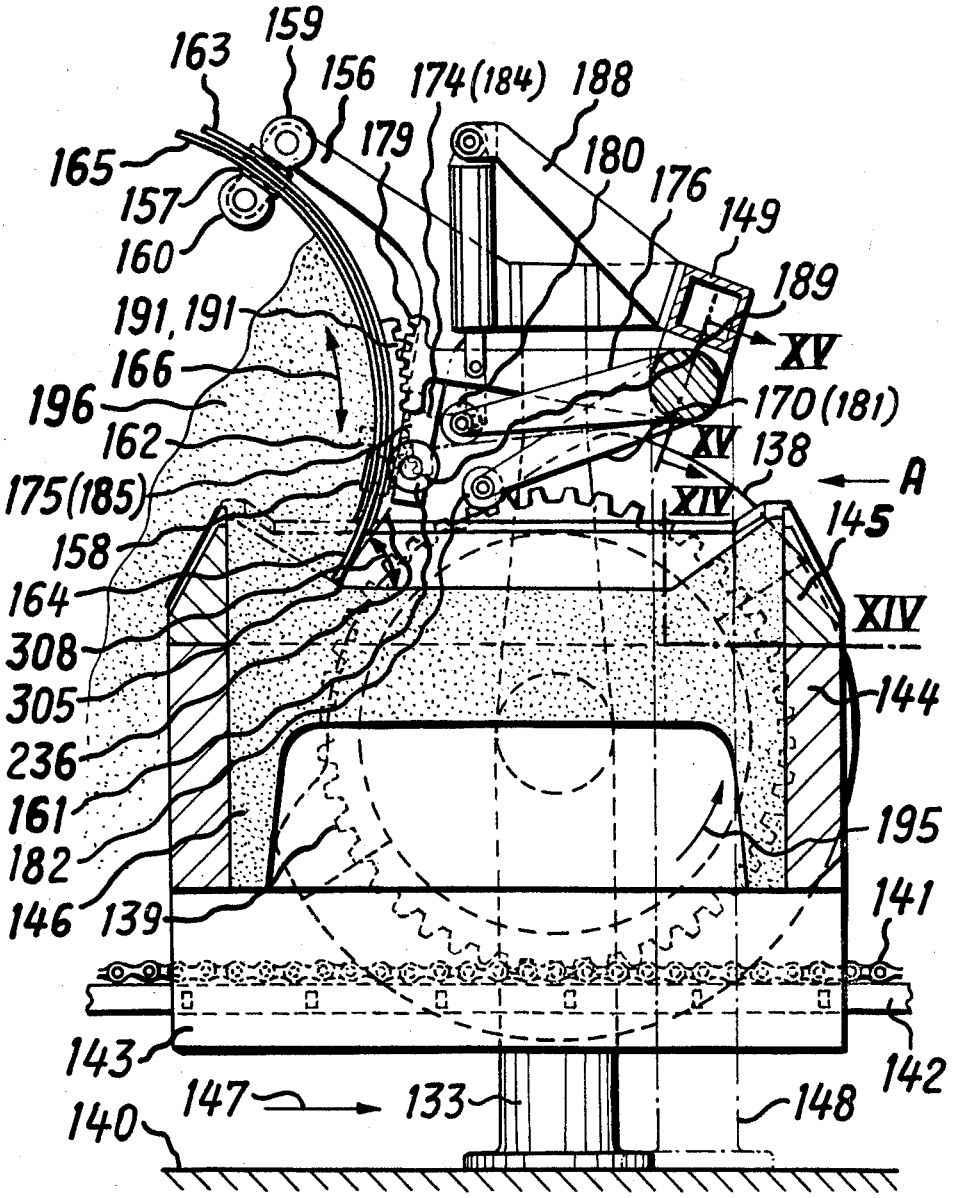
FIG. 13 is a section taken along the line XIII—XIII in FIG. 14.
Figure 14:
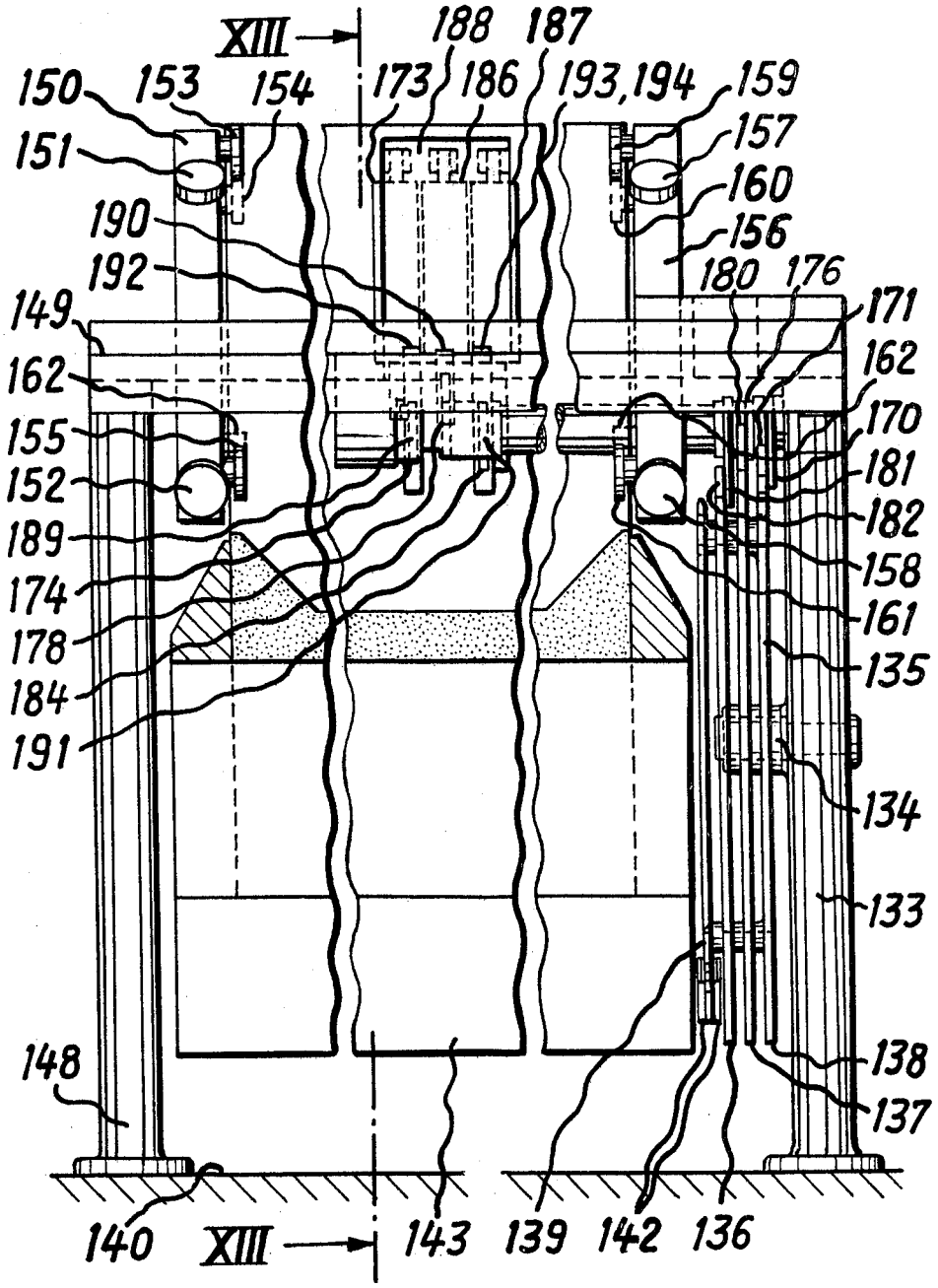
FIG. 14 is a view partly in a section taken along the line XIV—XIV viewing FIG. 13 in the direction of arrow A.
Figure 15:
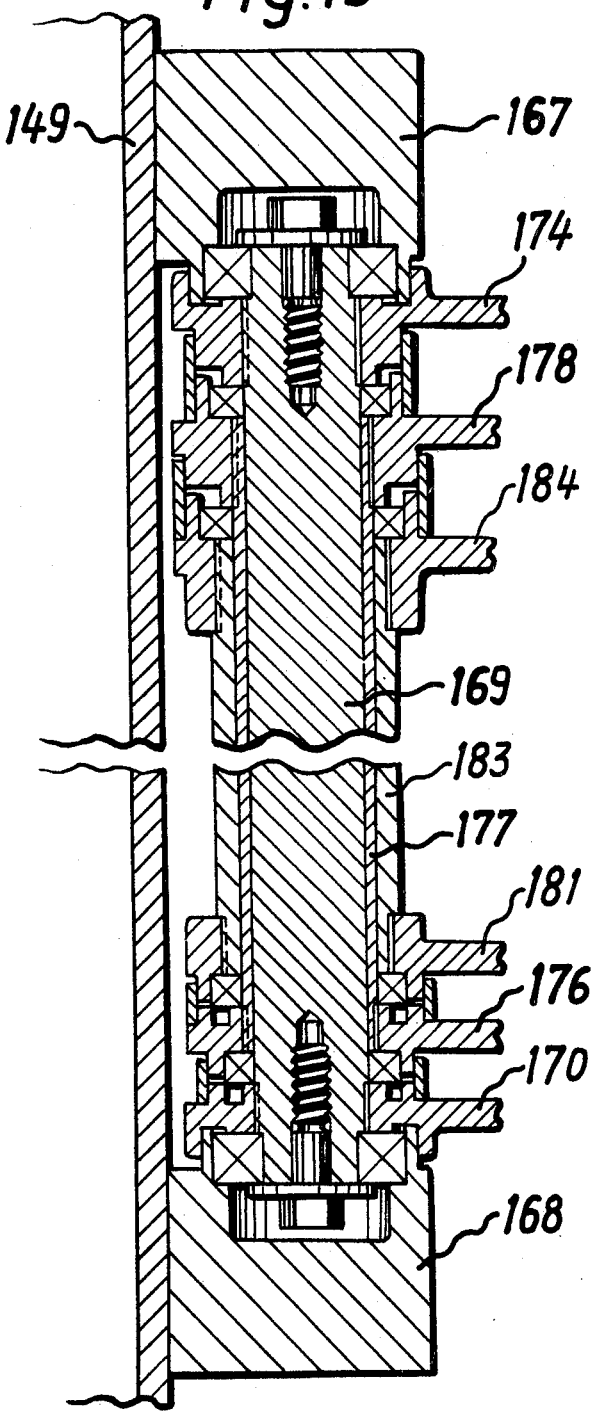
FIG. 15 is a section taken along the line XV—XV in FIG. 13.

FIGS. 13, 14 and 15 depict apparatus for carrying out the method according to the invention for the case utilizing the equipment depicted in FIGS. 1 and 2. The column 133, which bears on bottom 140, has a bearing pin 134, on which is mounted a drum 135, on which are secured cams 136, 137 and a gear wheel 139. The stationary gear wheel 139 engages a gear chain 141 which bears on a supporting construction 142, the parts 141 and 142 being drivingly connected with the pattern device 143, and molding box 144 on molding frame 145 containing molding sand 146 for movement in direction 147. Another column 148, which likewise bears on bottom 140, is rigidly connected with column 133 over a carrier 149 forming a gantry. The opening of this gantry is so designed that the pattern device 143, molding box 144, frame 145 and molding sand 146 can be moved together with chain 141, supporting construction 142, and the feed mechanism (not shown) in the direction of arrow 147.

On carrier 149 there is secured on one side a support 150, which carries guide rollers 151 and 152, as well as guide rollers 153, 154 and 155. On the other side of carrier 149 is secured a support 156 which carries guide rollers 159, 160 and 161. Connected with the supports 150 and 156 is an overarm 162, so that the strippers 163–165 can be moved over the guide rollers 151–155 and 157-161, as well as the overarms 162 in a circular path in the direction of the arrows 166. The strippers 163–165 are so arranged that the tangent 236 to the circular form at the point of the stripping edge forms an acute angle 308 with the direction of motion 147.

FIG. 15 shows a section through the bearings 167 and 168 which are rigidly connected with the carrier 149 and in which shaft 169 is rotatably mounted. A lever 170, which is provided with a roller 171, rolling on a cam 138, is rigidly connected over shaft 169 with a lever 174 which has a toothed segment 175. A lever 176 carrying a roller 180 which rolls on a cam 137 is rigidly connected over a tube 177, which is rotatably mounted on the shaft 169, with a lever 178 which has a toothed segment 179. Furthermore, a lever 181, which has a roller 182 rolling on a cam 136, is rigidly connected over a tube 183 rotatably mounted on tube 177, with a lever 184 which has a toothed segment 185.

Compressed air cylinders 173, 186 and 187 are hinged with a support 188 secured on carrier 149. They are also hinged with the levers 174, 178 and 184. When the compressed air cylinders 173, 186 and 187 are supplied with compressed air, the corresponding rollers 171, 180 and 182 are pressed on the corresponding cams 138, 137 and 136.

Lever 174 engages with its toothed segment 175 a toothed segment 189, which is rigidly connected with stripper 163. Lever 178 engages with its toothed segment a toothed segment 190, which is rigidly connected with stripper 164. Lever 184 engages with its toothed segment 185 a toothed segment 191 which is rigidly connected with stripper 165. Stripper 163 is provided with one slot 192 each for the toothed segments 190, 189 and 191 so that it can be moved independently of the position of the strippers 164 and 165. Stripper 164 has a slot 194 for the toothed segment 191 so that it can move independently of the position of stripper 165, and stripper 165 which is rigidly connected with the toothed segment 191 has no slots and is arranged first in the direction of motion 147. The drive of the strippers by toothed segments 189–191 has the advantage that only a very small tipping movement is generated during the movement of the strippers 163–165, which is expedient because of the sliding friction. Furthermore, this drive permits a very rapid replacement of the strippers, since it is only necessary to remove the overarms 162.

In the operation of the stripping device represented in FIGS. 13, 14 and 15, if the pattern device 143 is moved with the attached parts 144, 145 and 146 in the direction of motion 147, gear chain 141 and carrier 142 move at the same speed in the direction of motion 147. Gear wheel 139 engaging gear chain 141 turns drum 135 in the direction of motion 195 and thus also the cams 136, 137, 138 secured thereon. The compressed air cylinders 173, 186 and 187, which are under pressure, press the rollers 171, 180 and 182 on the cams 138, 137 and 136. Cam 138 is in operative connection with stripper 163, as described above, cam 137 with stripper 164, and cam 136 with stripper 165. In the represented example according to FIG. 13, stripper 163 thus corresponds to stripper 70 in FIG. 7 and stripper 164 to stripper 171 in FIG. 7. Stripper 165 is inoperative in the raised position, since the pattern device 143 has no attachable pattern part (e.g. 114). During the movement of the pattern device 143 and of the parts 141, 142, 144, 145 and 146 motionally connected with it, cam 138 controls stripper 163, and cam 137 controls stripper 164. The design of the cams 137 and 138 is not shown, since a person skilled in the art can readily determine the cam forms required for a certain application from the data in the description of FIGS. 5 – 12 and 13 – 15. During movement of the pattern device 143 and of the parts connected thereto in the direction of motion 147, the strippers 163–165, which are stationary relative to the direction of motion 147, strip off the excess molding sand 196, which drops vertically behind the pattern device 143 through bottom 140.

FIGS. 5 and 6 show a plane stripper. Further details of such an application of the present invention, particularly with regard to guidance and mounting of stripper 56, are not shown, since this is within the knowledge of one skilled in the art without further descriptive details. Stripper 56 is controlled by a cam 55 and is pressed on the latter by a compressed air cylinder (not shown). Cam 55 is rigidly connected with frame 54.

In contrast, FIGS. 13 and 14 show circular strippers 163–165 whose control elements are not rigidly connected with frame 145. These have the particular advantage that a considerable excess of molding sand can flow off unhindered over frame 145 transverse to the direction of motion 147. The circular design of the strippers represented in FIGS. 13 and 14 has furthermore the advantage that, with a great stripping depth of the individual strippers (see FIGS. 7, 8, 11 12), the displacement path becomes smaller than for the stripper according to FIG. 6, and in addition the blade angle of the stripper becomes more favorable with increasing stripping depth. Since there occurs at times rapid variation of the vertical position of the strippers, stripper 163 is preferably reinforced in its circular form due to its lightweight construction, for example, with spot-welded U-type channels in order to keep its weight low. The reinforced lightweight construction of stripper 163 permits the strippers 164 and 165 or others to be thin-walled, since they are pressed during the stripping process on stripper 163 and are therefore only slightly stressed. The circular design of stripper 163, if it is circularly reinforced, has the advantage that with greater stripping width and larger amounts to be stripped, it becomes more dimensionally stable with lower weight and more resistance to the stripping forces than with the plane stripper of FIGS. 5 and 6.

Figure 20:
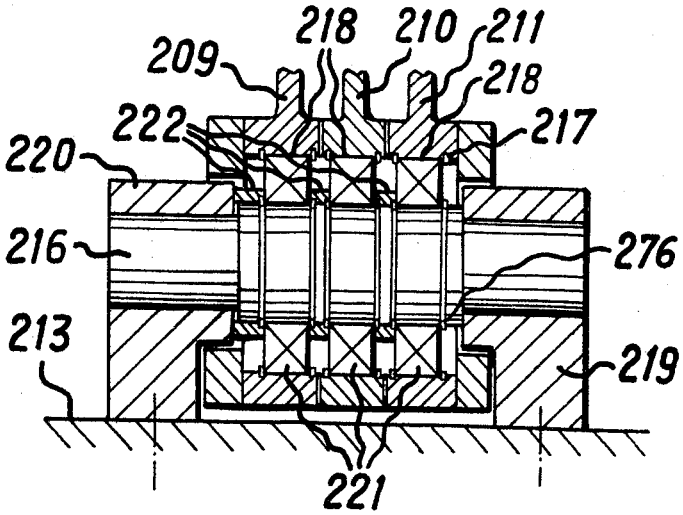
FIG. 20 is a section taken along the line XX—XX in FIG. 19.
Figure 19:
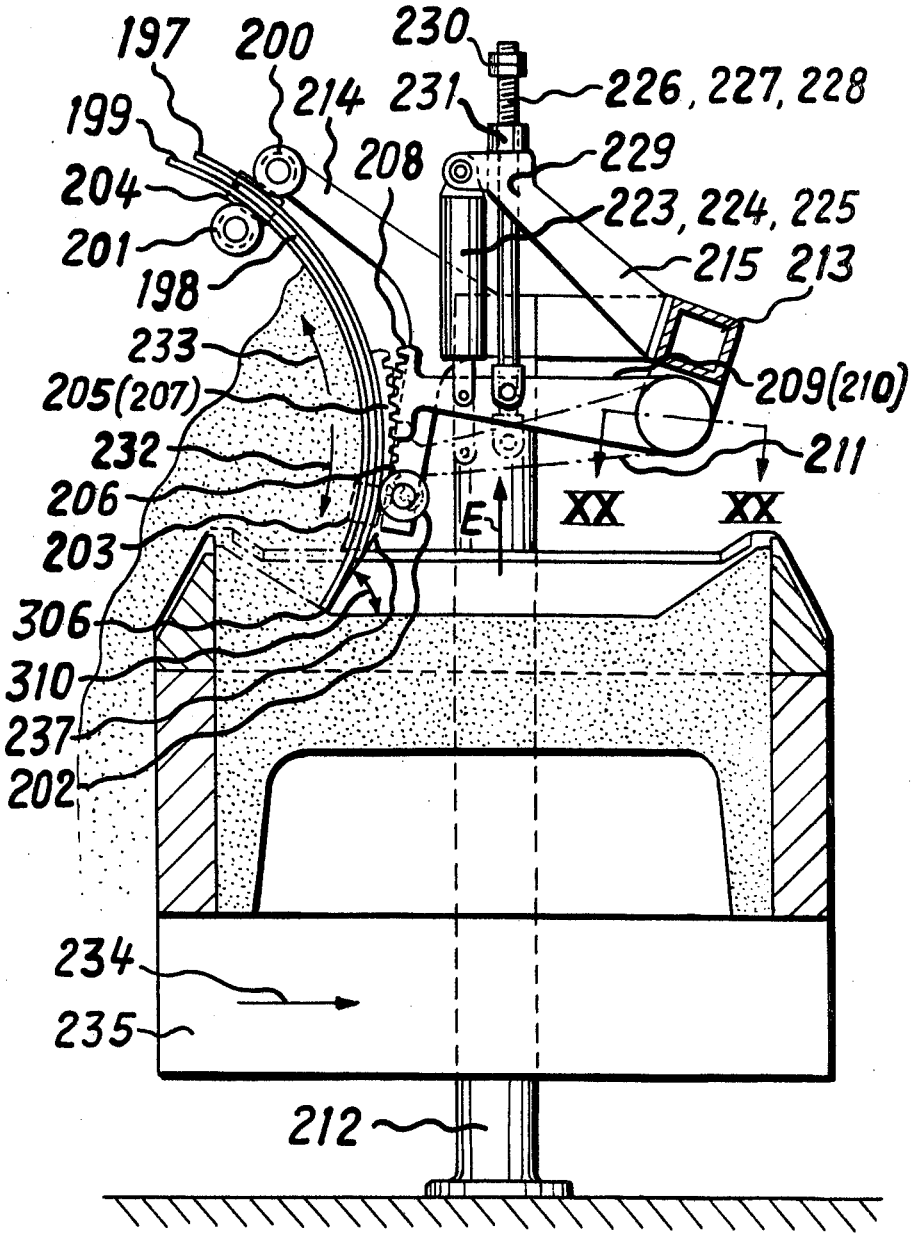
FIG. 19 is a sectional view of another embodiment of the invention.

FIGS. 19, 20 and 21 show another embodiment of the invnetion involving a mechanism which can be used for a molding machine including the parts depicted in FIGS. 1 and 2. The design of the stripper 197, 198 and 199, as well as the guidance by the rollers 200, 201, 202, 203, 204 and the acute angle 308 of tangent 237 at the strip edge 306 to the direction of motion 147 correspond to those in FIGS. 13 and 14. The design of the toothed segments 205, 206, 207 and 208 of the levers 209, 210, and 211, is likewise identical with those in FIGS. 13 and 14. The design of the columns 212 corresponds to column 148 in FIG. 14 and the design of the carriers 213 to carrier 149 in FIG. 14 and forms likewise a gantry with the columns 212. The design of support 214 is comparable to the supports 150 and 156 and the design of support 215 to support 188 in FIG. 13. These parts are therefore not described either with regard to their design or their operation.

The levers 209, 210 and 211, which are arranged centrally of the strippers 197, 198 and 199, are rotatably mounted on shaft 216 and are held with expanding rings 217 in their bores 218. The ball bearings 221 are secured on shaft 216 in a known manner in the axial direction by an expanding ring 276 and by distance rings 222. Shaft 216 bears in bearings 219, 220, which are rigidly connected with carrier 213. Three compressed air cylinders 223, 224 and 225, which are hinged, on the one hand, on support 215, and on the other hand, on the levers 209, 210 and 211, can be reversed by valves (not shown). Bolts 226, 227 and 228, which are arranged on the levers 209, 210, 211, are held in bores 229 of support 215 and have adjustable threaded nuts 230. Bushes 231 of elastic damping material, which rest on support 215, limit the path of the bolts 226, 227, 228, which is adjustable by nuts 230. In the operation of the embodiment of the stripping device according to FIGS. 19, 20 and 21, lowering of the strippers 197, 198, 199 in the direction of the arrow 232 and the lifting in the direction of the arrow 233 are effected by a corresponding reversal of the compressed air cylinders 223, 224, 225, the respective lowering speed and the respective lifting speed being adjusted by corresponding throttling of the compressed air line and of the exhaust line. The limitation of the lifting movement is effected by the limitation of the piston path in the respective cylinder, and of the lowering movement by adjusting the threaded nuts 230 on the respective bolts 226, 227, 228 to the corresponding bushes 231. The start of the lowering or lifting movement of the strippers 197–199 can be effected by time control of the respective valves, for example, electrically or pneumatically from a central control drum which is set in operation in the direction of motion 234 together with the movement of the pattern device 235. The control of the lowering and lifting movement of the strippers 197–199 can also be effected by path control over switching elements which are arranged on the pattern device 235 or on parts motionally connected with it.

Figure 16:
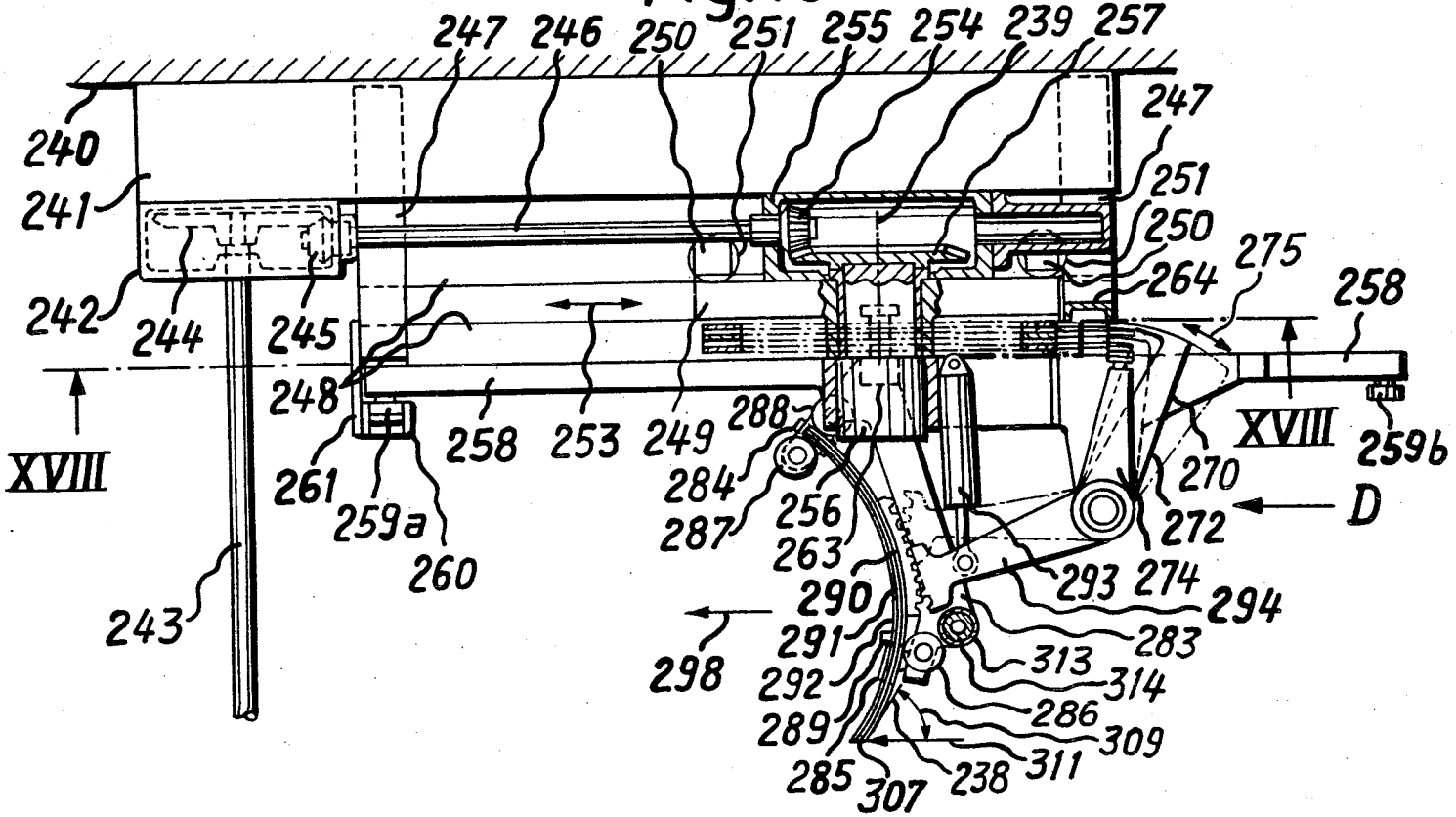
FIG. 16 is a section taken along the line XVI-XVI in FIG. 18.
Figure 18:
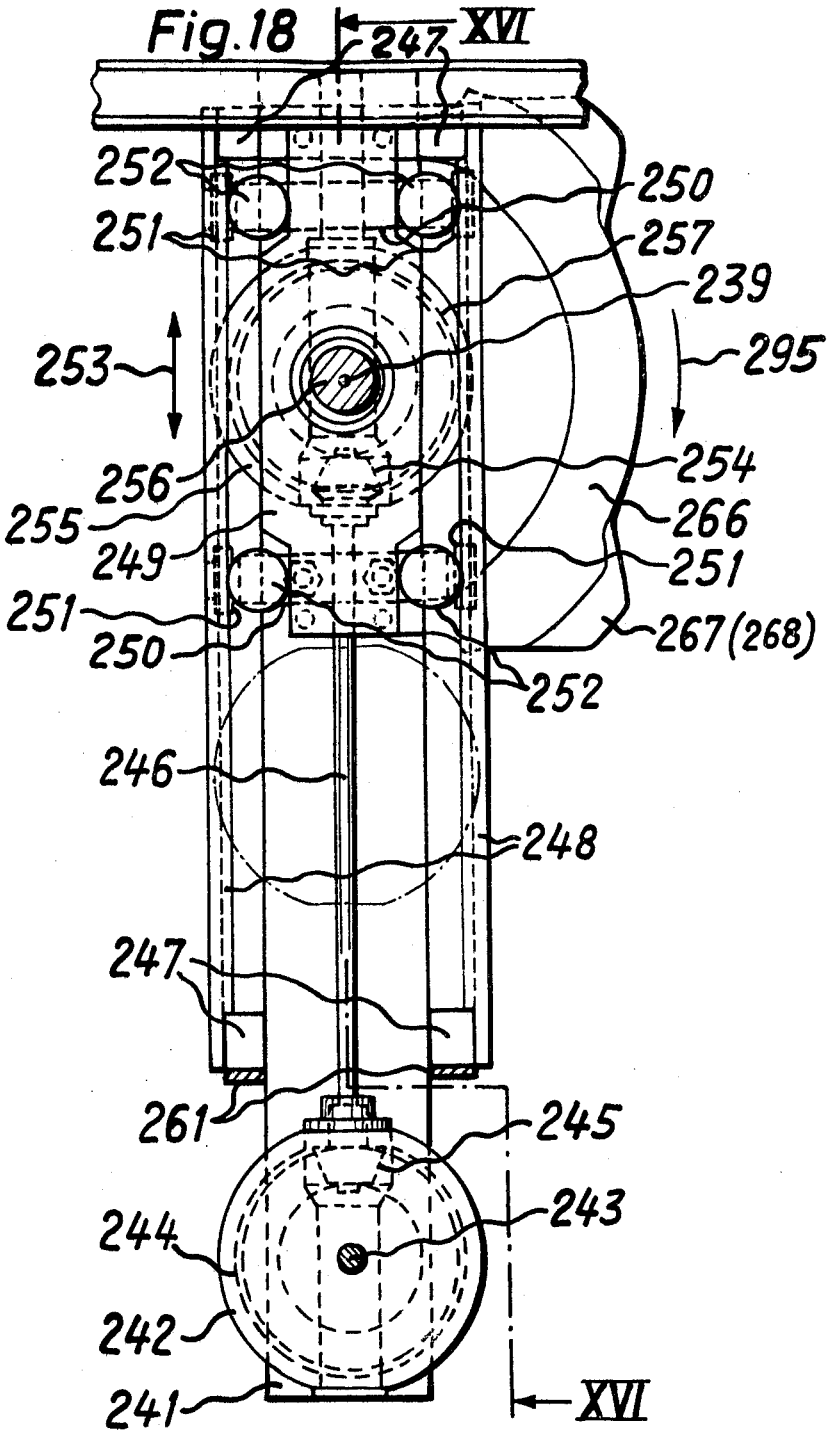
FIG. 18 is a section taken along the line XVIII—XVIII in FIG. 16.

FIGS. 16, 17 and 18 show an embodiment of the present invention which can be used together with a molding machine embodying the parts shown in FIGS. 3 and 4. FIGS. 4, 16 and 17, show a supporting construction 240, on which bear the sand containers (not shown) with the respective discharge and feed mechanisms. A carrier 241 is rigidly connected with supporting construction 240 and carries a miter gear 242 in which is mounted a shaft 243 which is nonrotatably connected with the rotary column 30 (see FIG. 3). Shaft 243 carries a bevel gear 244 which meshes with a pinion 245 underneath. Pinion 245 is rigidly connected with shaft 246. The parts 247, which are rigidly connected both with carrier 241 and with the guide arms 248, form the supporting construction for a car 249. Car 249 can be moved in the direction of the arrows 253 over parts with horizontally mounted rollers 251 and with vertically mounted rollers 252, and is held on all sides transverse to the direction of arrow 253. A pinion 254, which can be displaced on shaft 246, secured against rotation, is mounted in a housing 255 which is rigidly connected with car 249. In car 249 is vertically mounted a pivot 256 which is rigidly connected with a bevel gear 257 meshing with pinion 254. Pivot 256 carries two arms 258 (see also FIGS. 3 and 4) each of which carry a roller 259 which can move in guide 260. Guide 260 is connected over connecting piece 261 both with parts 247 and over supports (not shown) with supporting construction 240. Another arm 262 carries a roller 263 which can move in a guide 264, which is rigidly connected with supporting construction 240 both over the parts 247 and over the supports 265. Cams 266, 267 and 268 are rigidly connected with car 249.

On pivot 256 is secured another arm 277 which carries the guide rollers 278–282. An arm 283, which is branched off from arm 262, carries the guide rollers 284/288. A tube 313, which spaces the arms 277 and 283, is held together over an inner tube 314 with threaded nuts 315 and 316. An overarm 289, which is detachable so that the stripper can be easily replaced, completes the guidances of the strippers 290–292. The design of the levers 294, cylinders 293, of the respetive toothed segments and of the strippers 290–292, as well as their guidance are identical with those of FIGS. 13 and 14. They are therefore not described either in design or operation. A difference of this embodiment is that the levers 174, 178 and 184 in FIGS. 13, 14 and 15 are operatively connected with the levers 170, 176 and 181 over shafts or tubes, while the levers 270, 272 and 274 are integral with the corresponding levers 294.

In the operation of the molding machine according to FIGS. 3, 4, 16, 17, 18, 20, 21 and 22a-e, if the pattern device 24 with molding box 25, frame 26 and sand filling, including the excess sand, is turned from position 22 in the direction of arrow 28 on a circular path 27 into press 20, the above mentioned parts 24–26 are lifted from a support (not shown) in position 22 by a rotary column 30 over an arm 31, turned by half a revolution in the press 20, and deposited on the mold table 33. The shaft 243 connected with the rotary column 30 is likewise turned by half a revolution in the direction of the arrow 28 and transmits this rotation over bevel gear 244, pinion 245, shaft 246, pinion 254 mounted for axial displacement on shaft 246, gear wheel 257 on pivot 257 and the parts connected with it. Since the transmission ratio of the bevel gears 244/245 is equal to that of 257/254 and the bevel gears are so arranged that shaft 243 turns in the same direction with the pivot 256, it follows necessarily that while the pattern device 24 with the parts drivingly connected therewith turns by a half revolution from position 22 into the press 20, the pivot 256 with the parts connected with it, hence with the strippers 290–292, turns in the same direction by a half revolution. Since the strippers 290–292 face shaft 243 at the start of the rotation from position 22 in the direction of arrow 298, and rotate in the same direction and at the same speed as the pattern device 24 with its parts, the strippers 290–292 are always held during the above mentioned rotation by a half revolution transverse to the direction of motion 28, hence also transverse to the pattern device 24. During the above mentioned rotation, the levers 270, 272 and 274, held with pivot 256 over their bearing (see FIGS. 16, 17), are also turned in the direction of motion 295 (see FIG. 18), and are controlled in their vertical position by the respective cams 266, 267 and 268 together with the strippers 290–292 during the rotation in the manner already described for FIGS. 13 and 14. The tangent 238 on the circular stripper 290 at the strip edge 307 forms with the direction of motion 311 an acute angle 309.

The schematic FIGS. 22*a–e* serve to illustrate the function of the rollers 259*a*, 259*b* and 263 rigidly connected with pivot 256 over the arms 258 and 262, and of the guides 260 and 264. Consequently the same reference numbers are partly used in FIGS. 22*a–e* as in FIGS. 3, 4, 16–18.

Figures 22A, 22B, 22C, 22D, 22E:
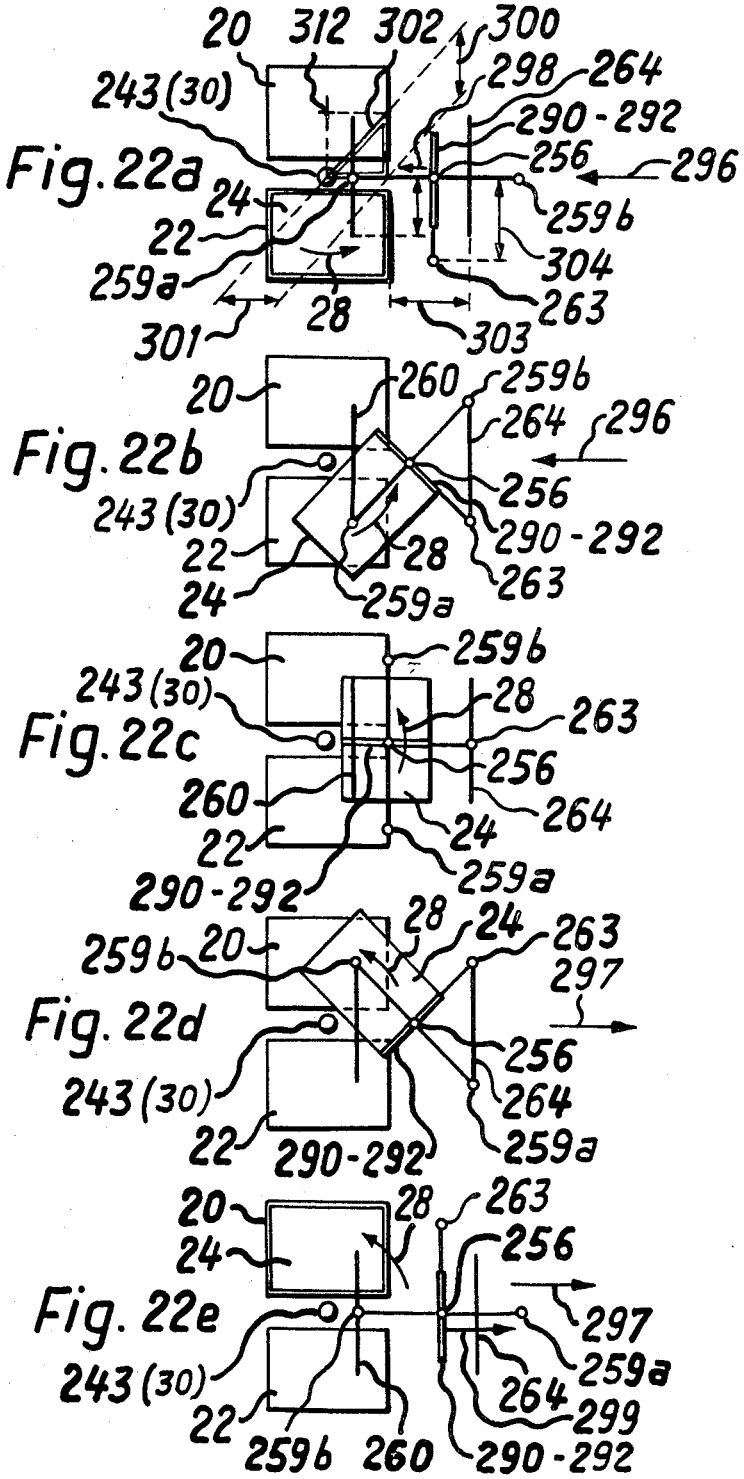
FIGS. 22*a* through 22*e* are schematic representations depicting functions of parts of the invention connected to the pivot.

FIG. 22*a* shows the pattern device 24 in position 22. In this position roller 259*a* is held in guide 260, so that the position of pivot 256 in the direction of motion 296 is fixed by guide 260. When the pattern device 24 turns in the direction of motion 28 by 45° into the position according to FIG. 22*b*, pivot 256 moves in the direction of motion 296. In this position roller 259*b* leaves guide 260 and roller 263 engages guide 264, which defines during the following rotation by 90° the position of pivot 256 first in the direction of rotation 296 and then, after reaching the position according to FIG. 22*c*, up to the position according to FIG. 22*d* in the direction of motion 297. In the position according to FIG. 22*b*, the strippers 290–292 reach the pattern device 24 and are concentric with the latter and perpendicular to the instantaneous direction of motion 28, and the stripping process starts. In the position according to FIG. 22*c* the stripping process has been half completed, and in the position according to FIG. 22*d* it is fully completed. If pivot 256 turns by another 45° in the direction of motion 28 into the position according to FIG. 22*e*, roller 263 leaves guide 264 and roller 259*b* engages guide 260, so that the rotation of the pattern device by a half revolution from position 22 into press 20 is completed, and the strippers 290–292 face away from shaft 243 in the direction of the arrow 299. In order to ensure that the strippers 290–292 are guided centrally to the pattern device 24 during the entire stripping process from the position according to FIG. 22*b* into the position according to FIG. 22*d*, and in order to obtain a straight guide 264, it is necessary that the length of guide 264 corresponds to the distance from the center of the pattern device 24 in position 22 to the center of the pattern device 24 in the position in press 20. Furthermore the distance 303 from the center of the guide 264 to the start of the pattern device 24 must be selected equal to the distance 304 of the roller axis 263 to the axis of pivot 256. The distance 304 corresponds to the hypotenuse 302. The hypotenuse 302 is formed by the sides 301 and 300. The length of side 301 must correspond at least to the distance between the axis of rotary column 30, which is identical with shaft 234 and the limitation of the pattern device 24. The length of the side 300 corresponds to the distance between the axis of rotary column 30 and the center 312 of the pattern device 24. In order to obtain a straight guide 260, whose length corresponds in this case to guide 264, the distance between the axis of pivot 256 and the roller axis 259*a* on the one hand, and roller 259*b* on the arms 258, on the other hand, must be selected equal to the distance 304.

The arrangement shown in FIGS. 22*a–e* has the advantage that, when the rotary movement starts, the position of pivot 256, and thus the position of car 249 moves from the rest position with increasing speed into the position according to FIG. 22*b* and arrives with decreasing speed in the reverse position according to FIG. 22*d*, after which pivot 256, with car 249, reducing its speed to zero, arrives at the end of the rotation in the position according to FIG. 22*e*, which corresponds to the position according to FIG. 22*a*. It is readily possible to shorten the distance, for example, of the axes of the rollers 258*a*, 259*b* and 263, but this has the disadvantage that the guides 260 and 264 must be curved, and the acceleration of car 249 with the parts connected with it is increased.

The mechanical solution described herein has the advantage that it not only operates accurately but is also trouble-free. Naturally it is also possible to control the rotary movement of pivot 256 with adjusting motors, which can be driven in a known manner electrically or pneumatically, in synchronism with rotary column 30. It is also possible to control the simultaneous movement of car 249 in the direction of motion 297 by corresponding cams directly or hydraulically, as required.

The present invention has the advantage that the considerable increase in molds that can be produced per pattern device and per hour leads to an improved adaptability to the conditions of a foundry as regards differences in the pattern dimensions and cooling times of the casting of grey iron, ferritic spheroidal graphite iron, etc., since the required size of the pattern device must be selected mostly only according to the largest pattern dimension and not according to the production capacity. Production planning is thus facilitated and special requests can be met without additional costs.

It should be pointed out that the molding machines according to the invention which are represented in FIGS. 1, 2 and 3, 4, permit the compression of the mold both by pressing and by pressing and jarring, while in the molding machine represented in FIGS. 23, 24 the compression of the mold is confined to pressing.

The height of frame 54, 105 is preferably adapted to the profile of the sand to be stripped off. This facilitates the outflow of the stripped excess molding sand. This adaptation of the frame is not necessary for carrying out the method.

While specific embodiments of the invention have been shown and described in detail to illustrate the application of the inventive principles, it will be understood that the invention may be embodied otherwise without departing from such principles.

I claim:

1. In a method for the producton of a foundry mold utilizing mold forming apparatus including a pattern device, a molding box arranged on said pattern device and a frame attached to said molding box wherein a surplus of molding material is initially filled in over said pattern device in excess of the amount required for the production of said mold and wherein only a single compression operation is effected the improvements comprising the steps of stripping said surplus molding material off with profiled stripper means after said molding material has been filled in and with said frame attached to said molding box, and subsequently performing said compression operation with said frame attached to said molding box.

2. A method according to claim 1 wherein said surplus molding material is stripped off utilizing stripper means having a stripping profile shaped in dependence upon the form of said pattern device.

3. A method according to claim 1 wherein said surplus molding material is stripped off along a profile which is maintained constant during the stripping process.

4. A method according to claim 1 wherein said surplus molding material is stripped off along a profile which is varied during the stripping process.

5. A method according to claim 1 wherein said initial filling of said surplus of molding material is performed by a substantially uniform pouring of said molding material simultaneously over the entire pattern device.

6. A method according to claim 1 wherein said mold forming apparatus is moved during the mold production process from a position at which said filling of said molding material is effected to another position at which said compression operation takes place, said apparatus being moved along a substantially linear path, and wherein said stripper means is moved vertically relative to said molding box.

7. A method according to claim 1 wherein said mold forming apparatus is moved during the mold production process from a position at which said filling of said molding material is effected to another position at which said compression operation takes place, said apparatus being moved by rotation along a substantially circular path, wherein said stripper means is moved vertically relative to said molding box and horizontally in the same direction of rotation and at the same angular speed as said mold forming apparatus, and wherein said stripper means is guided transversely to the direction of motion and concentrically of said mold forming apparatus.

8. In a method for the production of a foundry mold utilizing mold forming apparatus including a pattern device, a molding box arranged on said pattern device and a frame attached to said molding box wherein a surplus of molding material is initially filled in over said pattern device in excess of the amount required for the production of said mold and wherein only a single compression operation is effected the improvement comprising the steps of stripping said surplus molding material off from over said pattern device after said molding material has been filled in and with said frame attached to said molding box, said stripping being performed such that a relatively greater amount of molding material is stripped from portions of said molding material overlying portions of said pattern device having a relatively greater height and a relatively lesser amount of molding material is stripped from portions of said molding material overlying portions of said pattern device having a relatively lesser height, and subsequently performing said compression operation with said frame attached to said molding box.

9. A method according to claim 8 wherein said stripping is performed such that the amount of molding material stripped from given portions of said molding material is generally directly proportional to the height of portions of said pattern device over which said given portions of said molding material are located.

10. Apparatus for the production of a foundry mold comprising a pattern device, a molding box arranged on said pattern device, a frame attached to said molding box, means operatively associated with said molding box for filling said molding box with molding material, said frame being arranged independently of said means for filling said molding box, stripper means operatively associated with said molding box for stripping from said molding box excess molding material introduced therein by said filling means, said stripper means having a profiled configuration adapted to be applied to said molding material to effect stripping thereof in conformity with said profiled configuration, control means operatively associated with said stripper means for operating said stripper means to effect adjustment in the height thereof in accordance with a predetermined program, and feeder means operatively associated with one of said molding box and said stripper means and being adapted to effect relative movement between said stripper means and said molding box, the extent of said relative movement corresponding at least to the horizontal extension of said molding box in the direction of said relative movement, said profiled configuration of said stripper means being configured with a predetermined relationship relative to the shape of said pattern device thereby to effect stripping of said molding material according to the shape of the pattern device which is utilized in forming said mold.

11. Apparatus according to claim 10 wherein said profiled configuration of said stripper means is such that said stripper means operates to strip a relatively greater amount of molding material from portions of said molding material overlying portions of said pattern device having a relatively greater height and a relatively lesser amount of molding material from portions of said molding material overlying portions of said pattern device having a relatively lesser height.

12. Apparatus according to claim 10 wherein said profiled configuration of said stripper means is such that the amount of molding material stripped from given portions of said molding material is generally directly proportional to the height of portions of said pattern device over which said given portions of said molding material are located.

13. Apparatus according to claim 10 wherein said pattern device is moved in a given direction of motion during production of said foundry mold and wherein said stripper means comprise a planar configuration arranged to extend at an acute angle relative to said direction of motion.

14. Apparatus according to claim 10 including compressed air cylinder means operatively associated with said stripper means for pressing said stripper means in a direction toward said molding material.

15. Apparatus according to claim 10 wherein said feeder means is structured such that said pattern device and the parts connected therewith are moved in a linear path.

16. Apparatus according to claim 10 further including a press having a mold table and a press plate, wherein said filling means is arranged above said mold table of the press and wherein said feeder device is so structured that said stripper means is connected with said press plate and is adapted to be retracted and extended in a linear path over said mold table.

17. Apparatus according to claim 10 wherein said stripper means comprises a profiled configuration adapted to strip off said excess molding material to impart thereto a profile which conforms to the profile of said pattern device.

18. Apparatus for the production of a foundry mold comprising a pattern device, a molding box arranged on said pattern device, a frame attached to said molding box, means operatively associated with said molding box for filling said molding box with molding material, stripper means operatively associated with said molding box for stripping from said molding box excess molding material introduced therein by said filling means, said stripper means having a profiled configuration adapted to be applied to said molding material to effect stripping thereof in conformity with said profiled configuration, control means operatively associated with said stripper means for operating said stripper means to effect adjustment in the height thereof in accordance with a predetermined program, and feeder means operatively associated with one of said molding box and said stripper means and being adapted to effect relative movement between said stripper means and said molding box, the extent of said relative movement corresponding at least to the horizontal extension of said molding box in the direction of said relative movement, said stripper means comprising a plurality of profiled strippers, each of said profiled strippers being mounted to be independently adjustable in height, said apparatus including cam means operatively associated with said profiled strippers for individually adjusting the height of said profiled strippers.

19. Apparatus for the production of a foundry mold comprising a pattern device, a molding box arranged on said pattern device, a frame attached to said molding box, means operatively associated with said molding box for filling said molding box with molding material, stripper means operatively associated with said molding box for stripping from said molding box excess molding material introduced therein by said filling means, said stripper means having a profiled configuration adapted to be applied to said molding material to effect stripping thereof in conformity with said profiled configuration, control means operatively associated with said stripper means for operating said stripper means to effect adjustment in the height thereof in accordance with a predetermined program, and feeder means operatively associated with one of said molding box and said stripper means and being adapted to effect relative movement between said stripper means and said molding box, the extent of said relative movement corresponding at least to the horizontal extension of said molding box in the direction of said relative movement, said pattern device being moved in a given direction during production of said foundry mold, said stripper means being adapted to strip off said molding material along a plurality of different profiles, said stripper means comprising a plurality of profiled strippers each corresponding to one each of said different profiles to be stripped off.

20. Apparatus according to claim 19 wherein said plurality of profiled strippers are sequentially arranged relative to said direction of motion of said pattern device, with the profiled stripper which is arranged last relative to said direction of motion being profiled independently of the form of said pattern device.

21. Apparatus for the production of a foundry mold comprising a pattern device, a molding box arranged on said pattern device, a frame attached to said molding box, means operatively associated with said molding box for filling said molding box with molding material, stripper means operatively associated with said molding box for stripping from said molding box excess molding material introduced therein by said filling means, said stripper means having a profiled configuration adapted to be applied to said molding material to effect stripping thereof in conformity with said profiled configuration, control means operatively associated with said stripper means for operating said stripper means to effect adjustment in the height thereof in accordance with a predetermined program, and feeder means operatively associated with one of said molding box and said stripper means and being adapted to effect relative movement between said stripper means and said molding box, the extent of said relative movement corresponding at least to the horizontal extension of said molding box in the direction of said relative movement, said pattern device being moved in a given direction of motion during production of said foundry mold, said stripper means comprising a circular cross sectional configuration taken along a vertical plane extending transversely to said direction of motion, with a tangent to said circular configuration taken at a strip edge of said stripper means which contacts said molding material during the stripping operation extending to form an acute angle relative to said direction of said motion.

22. Apparatus for the production of a foundry mold comprising a pattern device, a molding box arranged on said pattern device, a frame attached to said molding box, means operatively associated with said molding box for filling said molding box with molding material, stripper means operatively associated with said molding box for stripping from said molding box excess molding material introduced therein by said filling means, said stripper means having a profiled configuration adapted to be applied to said molding material to effect stripping thereof in conformity with said profiled configuration, control means operatively associated with said stripper means for operating said stripper means to effect adjustment in the height thereof in accordance with a predetermined program, and feeder means operatively associated with one of said molding box and said stripper means and being adapted to effect relative movement between said stripper means and said molding box, the extent of said relative movement corresponding at least to the horizontal extension of said molding box in the direction of said relative movement, said feeder means including bevel gear means for moving said pattern device along a circular path between a filling position and a compression position, horizontally rotating carrier means for said stripper means arranged in operative engagement with said bevel gear means to rotate said stripper means with the same angular speed and in the same angular direction of rotation as the movement of said pattern device in said circular path while simultaneously effecting a contrary relative linear movement therebetween to move said pattern device and said stripper means relative to each other in opposite linear directions to effect the stripping operation, a first guide arm rotatably mounted on said carrier means extending horizontally and parallel to said stripper means, an upwardly directed guide roller at the outer end of said guide arm spaced from the axis of rotation thereof a distance equal to the length of the hypotenuse of a triangle formed by said hypotenuse and two sides, one of said sides corresponding to the distance from the axis of rotation of said pattern device to the geometric center of said pattern device, with the other of said sides corresponding to at least one half the length of said pattern device, a guide provided on the turning side of said pattern device having a linear configuration corresponding to the length of the distance between the center of said pattern device in said filling position and the center of said pattern device in said compression position, said guide being arranged parallel to a connecting line extending between said centers of said pattern device when in said filling position and when in said compression position, and at a distance from the mold ends of the turning side corresponding to the length of said hypotenuse.

23. Apparatus according to claim 22 wherein said carrier means includes two opposed guide arms extending perpendicularly to said first guide arm having thereon downwardly directed guide rollers equivalently spaced from the axis of rotation of said pattern device and a further guiide having the same length as said first guide arm and periodically engaged by said downwardly directed guide rollers, said further guide being arranged away from said first guide arm in the direction of the center of rotation of said pattern device by double the length of said other side of said triangle.

* * * * *